US010036124B2

(12) United States Patent
Skaggs et al.

(10) Patent No.: US 10,036,124 B2
(45) Date of Patent: Jul. 31, 2018

(54) SEPARATED TREATMENT OF PAPER SUBSTRATE WITH MULTIVALENT METAL SALTS AND OBAS

(71) Applicant: INTERNATIONAL PAPER COMPANY, Memphis, TN (US)

(72) Inventors: Benny J. Skaggs, Springboro, OH (US); Brian W. Brollier, Cincinnati, OH (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 30 days.

(21) Appl. No.: 15/332,589

(22) Filed: Oct. 24, 2016

(65) Prior Publication Data

US 2017/0037578 A1 Feb. 9, 2017

Related U.S. Application Data

(63) Continuation of application No. 13/747,566, filed on Jan. 23, 2013, now abandoned.

(Continued)

(51) Int. Cl.

| | |
|---|---|
| ***D21H 21/14*** | (2006.01) |
| ***D21H 23/22*** | (2006.01) |
| ***D21H 23/56*** | (2006.01) |
| ***B05D 1/02*** | (2006.01) |
| ***B05D 1/38*** | (2006.01) |

(Continued)

(52) U.S. Cl.

CPC ..... *D21H 21/14* (2013.01); *B05D 1/02* (2013.01); *B05D 1/38* (2013.01); *B05D 3/12* (2013.01); *B05D 5/06* (2013.01); *D21H 11/08* (2013.01); *D21H 19/10* (2013.01); *D21H 19/38* (2013.01); *D21H 21/28* (2013.01); *D21H 23/22* (2013.01); *D21H 23/56* (2013.01); *B05D 2203/22* (2013.01); *D21H 11/14* (2013.01); *D21H 17/66* (2013.01); *D21H 21/30* (2013.01)

(58) Field of Classification Search

None

See application file for complete search history.

(56) References Cited

U.S. PATENT DOCUMENTS

| | | | |
|---|---|---|---|
| 3,293,114 | A | 12/1966 | Kenaga et al. |
| 3,533,908 | A | 10/1970 | Hoogsteen |

(Continued)

FOREIGN PATENT DOCUMENTS

| | | |
|---|---|---|
| DE | 19945580 | 4/2001 |
| EP | 0629741 | 12/1994 |

(Continued)

OTHER PUBLICATIONS

G.A. Smook, Handbook for Pulp and Paper Technologists, 2nd edition, 1992 Chap 4,pp. 36-44, Chap 5, pp. 45-64, Chap 17, pp. 264-282, Chap 18, pp. 283-296.

(Continued)

*Primary Examiner* — Shamim Ahmed
*Assistant Examiner* — Bradford M Gates
(74) *Attorney, Agent, or Firm* — Thomas W. Barnes, III

(57) ABSTRACT

A process for providing printable substrates by separately treating one or both surfaces of a paper substrate with an optical brightening agent (OBA) and a multivalent metal salt drying agent, where one or both surfaces of the paper substrate is treated with one of these two agents at the size press, and where the surface(s) is treated with the other of these two agents before or after the size press.

56 Claims, 6 Drawing Sheets

Related U.S. Application Data

(60) Provisional application No. 61/589,513, filed on Jan. 23, 2012.

(51) Int. Cl.

| | |
|---|---|
| ***B05D 3/12*** | (2006.01) |
| ***B05D 5/06*** | (2006.01) |
| ***D21H 11/08*** | (2006.01) |
| ***D21H 19/10*** | (2006.01) |
| ***D21H 19/38*** | (2006.01) |
| ***D21H 21/28*** | (2006.01) |
| *D21H 11/14* | (2006.01) |
| *D21H 17/66* | (2006.01) |
| *D21H 21/30* | (2006.01) |

(56) References Cited

U.S. PATENT DOCUMENTS

| | | | |
|---|---|---|---|
| 3,556,934 | A | 1/1971 | Meyer |
| 4,022,965 | A | 5/1977 | Goheen et al. |
| 4,040,900 | A | 8/1977 | Mazzarella et al. |
| 4,075,136 | A | 2/1978 | Schaper |
| 4,133,688 | A | 1/1979 | Sack |
| 4,166,894 | A | 9/1979 | Schaper |
| 4,169,810 | A | 10/1979 | Gunther et al. |
| 4,174,417 | A | 11/1979 | Rydell |
| 4,264,325 | A | 4/1981 | Meyer et al. |
| 4,279,794 | A | 7/1981 | Dumas |
| 4,431,481 | A | 2/1984 | Drach et al. |
| 4,483,889 | A | 11/1984 | Andersson |
| 4,496,427 | A | 1/1985 | Davison |
| 4,986,882 | A | 1/1991 | Mackey et al. |
| 5,049,235 | A | 9/1991 | Barcus et al. |
| 5,125,996 | A | 6/1992 | Campbell et al. |
| 5,160,789 | A | 11/1992 | Barcus et al. |
| 5,209,953 | A | 5/1993 | Grupe et al. |
| 5,266,250 | A | 11/1993 | Kroyer |
| 5,360,420 | A | 11/1994 | Cook et al. |
| 5,443,899 | A | 8/1995 | Barcus et al. |
| 5,482,514 | A | 1/1996 | von Raven |
| 5,514,429 | A | 5/1996 | Kamihgaraguchi et al. |
| 5,531,728 | A | 7/1996 | Lash |
| 5,597,612 | A | 1/1997 | Schoen et al. |
| 5,662,773 | A | 9/1997 | Frederick et al. |
| 5,667,637 | A | 9/1997 | Jewell et al. |
| 5,698,074 | A | 12/1997 | Barcus et al. |
| 5,698,688 | A | 12/1997 | Smith et al. |
| H1704 | H | 1/1998 | Wallajapet et al. |
| 5,731,080 | A | 3/1998 | Cousin et al. |
| 5,873,913 | A | 2/1999 | Cowman et al. |
| 5,902,454 | A | 5/1999 | Nelson |
| 6,030,443 | A | 2/2000 | Bock et al. |
| 6,146,494 | A | 11/2000 | Seger et al. |
| 6,207,258 | B1 | 3/2001 | Varnell |
| 6,361,651 | B1 | 3/2002 | Sun |
| 6,426,382 | B1 | 7/2002 | Farrar et al. |
| 6,471,824 | B1 | 10/2002 | Jewell |
| 6,506,282 | B2 | 1/2003 | Hu et al. |
| 6,579,414 | B2 | 6/2003 | Jewell |
| 6,579,415 | B2 | 6/2003 | Jewell |
| 6,582,557 | B2 | 6/2003 | Jewell |
| 6,592,712 | B2 | 7/2003 | Koukoulas et al. |
| 6,592,717 | B2 | 7/2003 | Jewell |
| 6,723,846 | B1 | 4/2004 | Metzger et al. |
| 6,764,726 | B1 | 7/2004 | Yang et al. |
| 6,773,549 | B1 | 8/2004 | Burkhardt |
| 6,802,938 | B2 | 10/2004 | Mohan et al. |
| 6,818,101 | B2 | 11/2004 | Vinson et al. |
| 6,864,529 | B2 | 3/2005 | Mei et al. |
| 6,890,454 | B2 | 5/2005 | Farrar et al. |
| 6,893,473 | B2 | 5/2005 | Neogi et al. |
| 6,936,138 | B2 | 8/2005 | Attenberger et al. |
| 6,994,734 | B2 | 2/2006 | Yamaguchi et al. |
| 7,381,300 | B2 | 6/2008 | Skaggs et al. |
| 7,553,395 | B2 | 6/2009 | Stoffel et al. |
| 7,622,022 | B2 | 11/2009 | Skaggs et al. |
| 7,641,765 | B2 | 1/2010 | Blum et al. |
| 7,682,438 | B2 | 3/2010 | Song et al. |
| 7,972,477 | B2 | 7/2011 | Skaggs et al. |
| 8,382,947 | B2 | 2/2013 | Skaggs et al. |
| 2003/0013628 | A1 | 1/2003 | Farrar et al. |
| 2004/0014910 | A1 | 1/2004 | Wang |
| 2004/0016528 | A1 | 1/2004 | Varnell |
| 2005/0133184 | A1 | 6/2005 | Dourgherty et al. |
| 2006/0005935 | A1 | 1/2006 | Harris et al. |
| 2007/0087134 | A1 | 4/2007 | Koenig et al. |
| 2007/0113998 | A1 | 5/2007 | Park |
| 2007/0125267 | A1 | 6/2007 | Song et al. |
| 2008/0017337 | A1 | 1/2008 | Dugirals et al. |
| 2009/0317549 | A1 | 12/2009 | Tan et al. |
| 2010/0129553 | A1 | 5/2010 | Jackson et al. |
| 2011/0151149 | A1 | 6/2011 | Koenig |
| 2012/0003490 | A1 | 1/2012 | Skaggs et al. |
| 2013/0171462 | A1 | 7/2013 | Skaggs et al. |

FOREIGN PATENT DOCUMENTS

| | | |
|---|---|---|
| EP | 0666368 | 2/1995 |
| EP | 2386685 | 11/2011 |
| GB | 786543 | 11/1957 |
| GB | 903416 | 8/1962 |
| GB | 1373788 | 11/1974 |
| GB | 1533434 | 11/1978 |
| GB | 2307487 | 5/1997 |
| GB | 2357777 | 7/2001 |
| WO | WO-1996/00221 | 1/1996 |
| WO | WO-2008/124489 | 10/2008 |
| WO | WO-2009/110910 | 9/2009 |
| WO | WO-2011/112190 | 9/2011 |

OTHER PUBLICATIONS

G.A. Smook, Handbook for Pulp and Paper Technologists, 2nd edition, 1992 pp. 38-41, 45(including Table 4-7, and 46-65, pp. 273-278, pp. 283-285, pp. 289-292.

Strazdins The Sizing of Paper 2nd edition, W.F.Renolds, 1989, pp. 1-31.

SEPARATED TREATMENT OF PAPER SUBSTRATE WITH MULTIVALENT METAL SALTS AND OBAS

FIELD OF THE INVENTION

The present invention broadly relates to a process for providing printable substrates by separately treating one or both surfaces of a paper substrate with an optical brightening agent (OBA) (to impart improved brightness) and a multivalent metal salt drying agent (to impart improved dry time), wherein one or both surfaces of the paper substrate is treated with one of these two agents at the size press, and wherein the surface(s) is treated with the other of these two agents before or after the size press.

BACKGROUND

The brightness and whiteness of printable paper may be improved, for example, by treating the surface of the paper substrate with optical brightening agents (OBAs). OBAs are fluorescent materials which increase the brightness (e.g., white appearance) of paper substrate surfaces by absorbing the invisible portion of the light spectrum (e.g., from about 340 to about 370 nm) and converting this energy into the longer-wavelength visible portion of the light spectrum (e.g., from about 400 to about 500 nm). In other words, the OBAs convert invisible ultraviolet light and re-emits that converted light in the blue to blue-violet light region through fluorescence.

In improving the brightness or whiteness of paper substrates, OBAs often operate by compensating for a yellow tint or cast which may be present in paper substrates prepared from paper pulps which have, for example, been bleached to moderate levels. This yellow tint or cast is caused by the absorption of short-wavelength light (violet-to-blue) by the paper substrate. By treating the paper substrates with OBAs, this short-wavelength light causing the yellow tint or cast may be partially replaced, thus improving the brightness and whiteness of the paper substrate.

The use of OBAs in improving the brightness or whiteness of paper substrates is not without problems. These OBAs may interact or react with other chemicals used in papermaking. For example, many OBAs used in papermaking are anionic. Illustrative of these anionic OBAs are the stilbene-based sulfonates. By contrast, some of the chemicals used in papermaking are cationic, or have cationic moieties. These cationic chemicals used in papermaking may interact or react with these anionic OBAs such as the stilbene-based sulfonates. Such interactions or reactions may reduce the ability of these OBAs to optically brighten and whiten the paper substrate.

SUMMARY

According to a first broad aspect of the present invention, there is provided a process comprising the following steps:

(a) for a paper substrate comprising about 10% or less by weight mechanical pulp fibers and having a first surface and a second surface, treating at least one of the first and second surfaces at a size press with one of the following two agents: (1) an optical brightening agent or; (2) a multivalent metal salt drying agent, to provide a treated paper substrate having one of the two agents; and (b) before or after the size press, treating the at least one surface of the paper substrate of step (a) with the other of the two agents to provide a printable substrate;

(c) wherein the least one surface after steps (a) and (b) comprises the multivalent metal salt drying agent in an amount such that the at least one surface has a percent ink transferred ("IT %") value equal to or less than about 65% and a black print density value of at least about 1.15;

(d) wherein the optical brightening agent is present after steps (a) and (b) in an amount sufficient to impart to the at least one surface an ISO brightness value of at least about 90.

According to a second broad aspect of the present invention, there is provided a process comprising the following steps:

(a) for a paper substrate comprising greater than about 10% by weight mechanical pulp fibers and having a first surface and a second surface, treating at least one of the first and second surfaces at a size press with one of the following two agents: (1) an optical brightening agent or; (2) a multivalent metal salt drying agent, to provide a treated paper substrate having one of the two agents; and (b) before or after the size press, treating the at least one surface of the paper substrate of step (a) with the other of the two agents to provide a printable substrate;

(c) wherein the least one surface after steps (a) and (b) comprises the multivalent metal salt drying agent in an amount such that the at least one surface has a percent ink transferred ("IT %") value equal to or less than about 65% and a black print density value of at least about 1.15;

(d) wherein the optical brightening agent is present after steps (a) and (b) in an amount sufficient to impart to the at least one surface an ISO brightness value of at least about 75.

BRIEF DESCRIPTION OF THE DRAWINGS

The invention will be described in conjunction with the accompanying drawings, in which.

DETAILED DESCRIPTION

Figure 1:
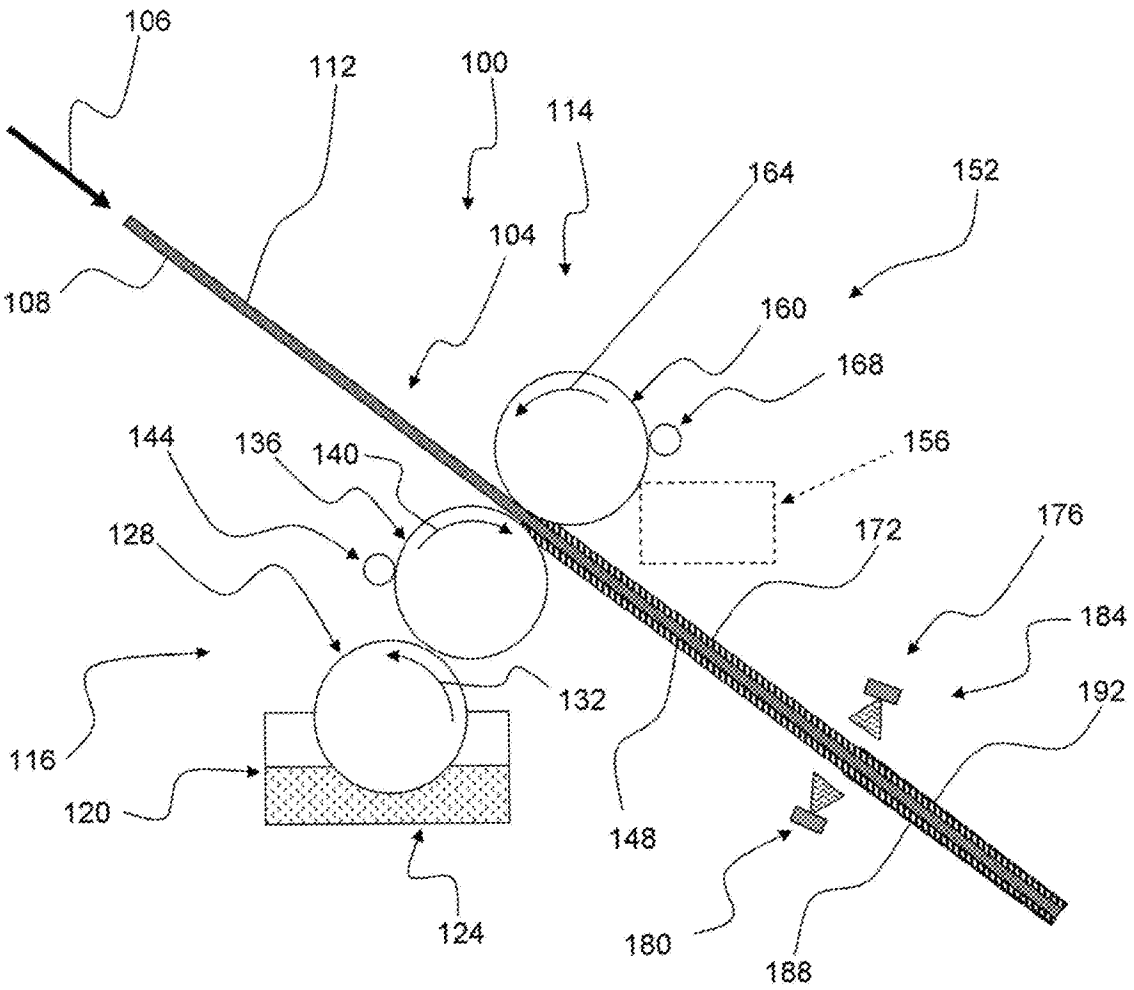
FIG. 1 is a schematic diagram of a system for carrying out an embodiment of a process for treating one or both surfaces of a paper substrate by first using a size press station, followed by using a spray station, wherein one of the multivalent salt metal drying agent or optical brightening agent is applied by a size press station, and wherein the other of these agents is applied by a spray station.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, directional terms such as "outer," "inner," "upper," "lower," "top", "bottom", "side," "front," "frontal," "forward," "rear," "rearward," "back," "trailing," "above," "below," "left," "right," "horizontal," "vertical," "upward," "downward," etc. are merely used for convenience in describing the various embodiments of the present invention. For example, the embodiments of the present invention illustrated in FIGS. 1-2, may be oriented in various ways.

For the purposes of the present invention, the term "printable substrate" refers to any paper substrate which may be printed on. Printable substrates may include webs, sheets, strips, etc., may be in the form of a continuous roll, a discrete sheet, etc.

For the purposes of the present invention, the term "paper substrate" refers to a fibrous web that may be formed, created, produced, etc., from a mixture, furnish, etc., comprising paper pulp fibers, internal paper sizing agents, etc., plus any other optional papermaking additives such as, for example, fillers, wet-strength agents, optical brightening agents (or fluorescent whitening agent), etc. The paper substrate may be in the form of a continuous roll, a discrete sheet, etc.

For the purposes of the present invention, the term "groundwood paper substrate" refers to a paper substrate comprising greater than about 10% by weight mechanical pulp fibers, for example, from about 15 to 100% by weight mechanical pulp fibers, such as from about 50 to about 95% by weight mechanical pulp fibers.

For the purposes of the present invention, the term "free paper substrate" refers to a paper substrate comprising about 10% or less by weight mechanical pulp fibers, for example, less than about 5% by weight mechanical pulp fibers, such as less than about 1% by weight mechanical pulp fibers.

For the purposes of the present invention, the term "mechanical pulp fibers" refers to pulp fibers which have been subjected to mechanical treatment such as beating, grinding, shredding, refining, etc., including mechanical pulp subjected to thermal pretreatment, chemical pretreatment, combination of thermal and chemical pretreatment, etc. Mechanical pulp fibers may include one or more of: stone groundwood (SGW) pulp fibers, pressurized groundwood (PGW) pulp fibers, refined mechanical pulp (RMP) fibers, thermo-refiner mechanical pulp (TRMP) fibers, pressure-refiner thermomechanical pulp (TMP) fibers, pressure/pressure thermomechanical pulp (PPTMP) fibers, chemomechanical pulp (CMP) fibers, including High Yield Sulfite (HYS) and High Yield Kraft (HYK) pulp fibers, chemi-refiner mechanical pulp (CRMP) fibers, chemi-thermo-mechanical pulp (CTMP) fibers, thermo-chemi-mechanical pulp (TCMP) fibers, thermo-mechanical-chemi pulp (TMCP) fibers, long fiber chemi-mechanical pulp/chemically treated long fiber (LFCMP/CTLF) pulp fibers, bleached chemi-thermo mechanical pulp (BCTMP) fibers, neutral sulfite semi chemical-pulp (NSSC) fibers, alkaline peroxide mechanical pulp (APMP/AAP) fibers, etc. See G. A. Smook, Handbook for Pulp and Paper Technologists ($2^{nd}$ Edition, 1992), pages 38-41, 45 (including Table 4-7), and 46-65, the entire contents and disclosure of which is herein incorporated by reference, for a general description of mechanical pulp, mechanical pulping, and mechanical pulp nomenclature and terminology, including semichemical pulping.

For the purposes of the present invention, the term "paper filler" refers commonly to mineral products (e.g., calcium carbonate, kaolin clay, etc.) which may be used in paper making to reduce materials cost per unit mass of the paper, increase opacity, increase smoothness, etc. These mineral products may be finely divided, for example, the size range of from about 0.5 to about 5 microns.

For the purposes of the present invention, the term "uncoated paper substrate" refers to a paper substrate which has 0 or substantially 0 paper surface loading of a coating composition present on one or both sides or surfaces of the paper substrate.

For the purposes of the present invention, the term "single-side coated paper substrate" refers to a paper substrate which has a surface loading of a coating composition present on one, but not both, sides or surfaces of the paper substrate.

For the purposes of the present invention, the term "double-side coated paper substrate" refers to a paper substrate which has a surface loading of a coating composition present on both sides or surfaces of the paper substrate.

For the purposes of the present invention, the term "calendered paper" refers to a paper substrate which has been subjected to calendering to, for example, smooth out the material for enabling printing on the material, to increase the gloss on the material surface, etc. For example, calendering may involve a process of using pressure (and optionally temperature and moisture) for embossing a smooth surface on the still rough material surface. Calendering may be carried out on a calender which may comprise a series of calender rolls at the end of, for example, a papermaking machine (on-line), or separate from the papermaking machine (off-line). Calendering may include supercalendering, hot-soft calendering, moisture-gradient calendering, extended nip calendering, belt calendering, etc. See G. A. Smook, Handbook for Pulp and Paper Technologists ($2^{nd}$ Edition, 1992), pages 273-78, the entire contents and disclosure of which is herein incorporated by reference, for a general description of calendering, as well as devices for carrying out calendering, that may be useful herein.

For the purposes of the present invention, the term "coating composition" refers to those compositions, which comprise, at minimum, one or more multivalent metal salt drying agents, or one or more optical brightening agents (OBAs). These coating compositions may also include other optional additives, such as, for example, a calcium carbonate pigment component, plastic pigments, substrate pigment binders, sizing agents, cationic dye fixing agents, solvents, diluents, anti-scratch and mar resistance agents, etc. The coating composition may be formulated as an aqueous solution, an aqueous slurry, a colloidal suspension, a liquid mixture, a thixotropic mixture, etc.

For the purposes of the present invention, the term "solids basis" refers to the weight percentage of each of the respective solid materials (e.g., multivalent metal salt drying agent(s); optical brightener agent(s) (OBAs); calcium carbonate pigment component; a cationic dye fixing agent; plastic pigment, sizing agent, etc.) present in the coating composition, coating, etc., in the absence of any liquids (e.g., water). Unless otherwise specified, all percentages given herein for the solid materials are on a solids basis.

For the purposes of the present invention, the term "solids content" refers to the percentage of non-volatile, non-liquid components (by weight) that are present in the composition, etc.

For the purposes of the present invention, the term "substrate pigment" refers to a material (e.g., a finely divided particulate matter) which may be used or may be intended to be used to affect optical properties of a printable substrate.

For the purposes of the present invention, the term "calcium carbonate" refers various calcium carbonates which may be used as substrate pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may used as a substrate pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "substrate pigment binder" refers to a binder agent for paper substrates which may be used to improve the substrate pigment binding strength of the coating composition, coating, etc. Substrate pigment binders may be hydrophilic. Suitable substrate pigment binders may include synthetic or naturally occurring polymers (or a combination of different polymers), for example, a polyvinyl alcohol (PVOH), starch binders, proteinaceous adhesives such as, for example, casein or soy proteins, etc.; polymer latexes such as styrene butadiene rubber latexes, acrylic polymer latexes, polyvinyl acetate latexes, styrene acrylic copolymer latexes, etc., or a combination thereof.

For the purposes of the present invention, the term "substantially free" refers to a coating composition, coating, etc., having less than about 0.1% of a particular component by weight of the coating composition, coating, etc.

For the purposes of the present invention, the term "starch binder" refers to a binder agent for substrate pigments and/or paper substrates which comprises starch, a starch derivative, etc., or a combination thereof. Suitable starch binders may be derived from a natural starch, e.g., natural starch obtained from a known plant source, for example, wheat, maize, potato, tapioca, etc. The starch binder may be modified (i.e., a modified starch) by one or more chemical treatments known in the paper starch binder art, for example, by oxidation to convert some of OH groups to —COOH groups, etc. In some cases the starch binder may have a small proportion of acetyl groups. Alternatively, the starch binder may be chemically treated to render it cationic (i.e., a cationic starch) or amphoteric (i.e., an amphoteric starch), i.e., with both cationic and anionic charges. The starch binder may also be a starch converted to a starch ether, or a hydroxyalkylated starch by replacing some —OH groups with, for example, $—OCH_2CH_2OH$ groups, $—OCH_2CH_3$ groups, $—OCH_2CH_2CH_2OH$ groups, etc. A further class of chemically treated starch binders which may be used are known as the starch phosphates. Alternatively, raw starch may be hydrolyzed by means of a dilute acid, an enzyme, etc., to produce a starch binder in the form of a gum of the dextrin type.

For the purposes of the present invention, the term "metal salt drying agent" refers to those metal salts which may improve the dry time of inks deposited or printed on printable substrates by ink jet printing processes. These metal drying salt agents comprise one or more multivalent metal drying salts, and may optionally further comprise one or more monovalent metal drying salts. The counter anions for these metal salts may include, for example, chloride, bromide, acetate, bicarbonate, sulfate, sulfite, nitrate, hydroxide, silicate, chlorohydrate, etc. The metal drying salt may be provided as an aqueous solution comprising, for example, from about 1 to about 60% (e.g., from about 10 to about 40%) of the multivalent metal drying salt.

For the purposes of the present invention, the term "multivalent metal salt drying agent" refers to those metal drying salts wherein the cationic moiety has a positive charge of two or more (e.g., a calcium cation, a magnesium cation, an aluminum cation, etc.) such as calcium salts, magnesium salts, aluminum salts, etc., and which are water soluble. Suitable multivalent metal drying salts (e.g., divalent salts, trivalent salts, etc.) may include one or more of: calcium chloride, calcium acetate, calcium hydroxide, calcium nitrate, calcium sulfate, calcium sulfite, magnesium chloride, magnesium acetate, magnesium nitrate, magnesium sulfate, magnesium sulfite, aluminum chloride, aluminum nitrate, aluminum sulfate, aluminum chlorohydrate, sodium aluminum sulfate, vanadium chloride, etc.

For the purposes of the present invention, the term "monovalent metal salt drying agent" refers to those metal drying salts wherein the cationic moiety is a monovalent cation having a positive charge of one (e.g., a sodium cation, a potassium cation, a lithium cation, etc.) such as sodium salts, potassium salts, lithium salts, etc. Suitable monovalent metal drying salts may include one or more of: sodium chloride, sodium acetate, sodium carbonate, sodium bicarbonate, sodium hydroxide, sodium silicates, sodium sulfate, sodium sulfite, sodium nitrate, sodium bromide, potassium chloride, potassium acetate, potassium carbonate, potassium bicarbonate, potassium hydroxide, potassium silicates, potassium sulfate, potassium sulfite, potassium nitrate, potassium bromide, lithium chloride, lithium acetate, lithium carbonate, lithium bicarbonate, lithium hydroxide, lithium silicates, lithium sulfate, lithium sulfite, lithium nitrate, lithium bromide, etc.

For the purposes of the present invention, the term "cationic dye fixing agent" refers to those cationic compounds (e.g., nitrogen-containing compounds) or mixtures of such compounds which may aid in fixing, trapping, etc., inks printed by inkjet printing processes, and which may provide other properties, including water fastness. These cationic dye fixing agents may include compounds, oligomers and polymers which contain one or more quaternary ammonium functional groups, and may include cationic water-soluble polymers that are capable of forming a complex with anionic dyes. Such functional groups may vary widely and may include substituted and unsubstituted amines, imines, amides, urethanes, quaternary ammonium groups, dicyandiamides, guanadines, biguanides, etc. Illustrative of such compounds are polyamines, polyethyleneimines, polymers or copolymers of diallyldimethyl ammonium chloride (DADMAC), copolymers of vinyl pyrrolidone (VP) with quaternized diethylaminoethylmethacrylate (DEAMEMA), polyamides, polyhexamethylene biguanide (PHMB), cationic polyurethane latexes, cationic polyvinyl alcohols, polyalkylamines dicyandiamid copolymers, amine glycidyl addition polymers, poly[oxyethylene (dimethyliminio) ethylene (dimethyliminio) ethylene] dichlorides, etc., or combinations thereof. These cationic dye fixing agents may include low to medium molecular weight cationic polymers and oligomers having a molecular equal to or less than 100,000, for example, equal to or less than about 50,000, e.g., from about 10,000 to about 50,000. Illustrative of such materials are polyalkylamine dicyandiamide copolymers, poly[oxyethylene (dimethyliminio ethylene(dimethyliminio ethylene] dichlorides and polyamines having molecular weights within the desired range. Cationic dye fixing agents suitable herein may include low molecular weight cationic polymers such as polyalkylamine dicyandiamid copolymer, poly[oxyethylene (dimethyliminio)ethylene(dimethyliminio)ethylene] dichloride, for example, low molecular weight polyalkylamine dicyandiamid copolymers. See U.S. Pat. No. 6,764,726 (Yang et al.), issued Jul. 20, 2004, the entire disclosure and contents of which is hereby incorporated by reference.

For the purposes of the present invention, the term "opacity" refers to the ability of a paper to hide things such as print images on subsequent sheets or printed on the back, e.g., to minimize, prevent, etc., show-through, etc. As used herein, opacity of the paper substrate may be measured by, for example, in terms of TAPPI opacity and show-through. TAPPI opacity may be measured by T425 om-91.

For the purposes of the present invention, the term "print quality" refers to those factors, features, characteristics, etc., that may influence, affect, control, etc., the appearance, look, form, etc., of a printed image on the printable substrate. Print quality of a paper substrate may be measured in terms of, for example, one or more of: (1) print density; (2) print contrast; (3) dry times); (4) edge acuity; (5) color gamut; (6) color richness; (7) print gloss; (8) print mottle; and (9) color-to-color bleed. For the purposes of the present invention, print quality of the paper substrate is primarily determined herein by measuring the print density, dry time, and edge acuity of the paper substrate.

For the purposes of the present invention, the term "print density" refers to the optical density ("OD") measured by using a reflectance densitometer (X-Rite, Macbeth. Etc.) which measures the light absorbing property of an image printed on a paper sheet. For example, the higher the print density, the darker the print image may appear. Higher print densities also provide a higher contrast, a sharper image for viewing, etc. Print density is measured herein in terms of the black print density (i.e., the print density of images which are black in color). The method for measuring black print density involves printing a solid block of black color on a paper sheet, and then measuring the optical density. The printer used to print the solid block of black color on the paper sheet is an HP Deskjet 6122, manufactured by Hewlett-Packard, (or its equivalent) which uses a #45 (HP product number 51645A) black ink jet cartridge (or its equivalent). The default setting of Plain Paper type and Fast Normal print quality print mode is used in printing the solid block of black color on the paper sheet. An X-Rite model 528 spectrodensitometer with a 6 mm aperture may be used to measure the optical density of the solid block of black color printed on the paper sheet to provide black print density values. The black print density measurement settings used are Visual color, status T, and absolute density mode. In general, acceptable black print density ("$OD_O$") values for black pigment are at least about 1.15 when using a standard (plain paper, normal) print mode for the HP desktop ink jet printer and when using the most common black pigment ink (equivalent to the #45 ink jet cartridge). Some embodiments of the paper substrates of the present invention may exhibit black print density ($OD_O$) values of at least about 1.25, for example, at least about 1.45. See also commonly assigned U.S. Pat. Appln. No. 2007/0087134 (Koenig et al.), published Apr. 19, 2007, the entire disclosure and contents of which is herein incorporated by reference, which describes how to carry out this black print density test.

For the purposes of the present invention, the term "print contrast" refers to the difference in print density between printed and unprinted areas.

For the purposes of the present invention, the term "dry time" refers to the time it takes for deposited ink to dry on the surface of a printable substrate. If the deposited ink does not dry quickly enough, this deposited ink may transfer to other printable substrate sheets, which is undesirable. The percentage of ink transferred ("IT %") is recorded as a measure of the dry time. The higher the amount of the percentage of ink transferred, the slower (worse) the dry time. Conversely, the lower the amount of the percentage of ink transferred, faster (better) the dry time. In general, embodiments of the paper substrates of the present invention provide a percent ink transferred ("IT %") value equal to or less than about 65%. In some embodiments of the paper substrates of the present invention, the IT % value may be equal to or less than about 50%, for example, equal to or less than about 40% (e.g., equal to or less than about 30%.

For the purposes of the present invention, the term "ink transfer" refers to a test for determining the dry time of a printable substrate, for example, printable paper sheets. "Ink transfer" is defined herein as the amount of optical density transferred after rolling with a roller, and is expressed as a percentage of the optical density transferred to the unprinted portion of the printable substrate (e.g., paper sheet) after rolling with a roller. The method involves printing solid colored blocks on paper having a basis weight of 20 lbs/1300 ft.$^2$, waiting for a fixed amount of time, 5 seconds after printing, and then folding in half so that the printed portion contacts an unprinted portion of the paper sheet, and rolling with a 4.5 lb hand roller as for example roller item number HR-100 from Chem Instruments, Inc., Mentor, Ohio, USA. The optical density is read on the transferred ($OD_T$), the non-transferred ($OD_O$) portions of the block, and an un-imaged area ($OD_B$) by a reflectance densitometer (X-Rite, Macbeth. Etc.). The percent transferred ("IT %") is defined as IT $\%=[(OD_T-OD_B)/(OD_O-OD_B)]\times 100$. See also commonly assigned U.S. Pat. Appln. No. 2007/0087134 (Koenig et al.), published Apr. 19, 2007, the entire disclosure and contents of which is herein incorporated by reference, which describes how to carry out the ink transfer test.

For the purposes of the present invention, the term "edge acuity (EA)" refers to the degree of sharpness (or raggedness) of the edge of a printed image (e.g., a printed line). Edge acuity (EA) may be measured by an instrument such as the QEA Personal Image Analysis System (Quality Engineering Associates, Burlington, Mass.), the QEA Scanner-IAS, or the ImageXpert KDY camera-based system. All of these instruments collect a magnified digital image of the sample and calculate an EA value by image analysis. The EA value (also known as "edge raggedness") is defined in ISO method 13660. This method involves printing a solid line 1.27 mm or more in length, and sampling at a resolution of at least 600 dpi. The instrument calculates the location of the edge based on the darkness of each pixel near the line edges. The edge threshold may be defined as the point of 60% transition from the substrate reflectance factor (light area, $R_{max}$) to the image reflectance factor (dark area, $R_{max}$) using the equation $R_{60}=R_{max}-60\%\ (R_{max}-R_{min})$. The edge raggedness may then be defined as the standard deviation of the residuals from a line fitted to the edge threshold of the line, calculated perpendicular to the fitted line. For embodiments of paper substrates of the present invention, the EA value may be less than about 15, for example, less than about 12, such as less than about 10 (e.g., less than about 8). See also commonly assigned U.S. Pat. Appln. No. 2007/0087134 (Koenig et al.), published Apr. 19, 2007, the entire disclosure and contents of which is herein incorporated by reference, which describes how to measure edge acuity (EA) values.

For the purposes of the present invention, the term "color gamut" refers to the total collection of possible colors in any color reproduction system and may be defined by a complete subset colors. A higher color gamut value indicates a more vivid color print quality. Color gamut may be obtained by measuring the CIE L*, a*, b* of a series of color blocks, including white (unprinted area), cyan, magenta, yellow, red, green, blue and black, and from these measured values, calculating a suitable color gamut. The CIE L* represents the whiteness. The value of L* may range from zero (representing black) to 100 (representing white or a perfectly reflecting diffuser). The value of a* represents the degree of green/red. A positive a* is red, while a negative a* is green. A positive b* is yellow, while a negative b* is blue. The CIE L*, a* and b* values may be measured by X-Rite 528 (or similar spectrophotometer) using a D65 light source and a 10-degree viewing angle.

For the purposes of the present invention, the term "color richness" refers to a more vivid or vibrant color print with high print density and high color gamut values.

For the purposes of the present invention, the term "gloss" refers to the ability of paper to reflect some portion of the incident light at the mirror angle. Gloss may be based on a measurement of the quantity of light specularly reflected from the surface of a paper specimen at a set angle, for example, at 75 degrees, such as in the case of 75 degree gloss (and as measured by TAPPI test method T 480 om-92).

For the purposes of the present invention, the term "print gloss" refers to a gloss measurement made on a printed paper substrate.

For the purposes of the present invention, the term "print mottle" refers to non-uniformity in the print image which may be due to unevenness in ink lay, non-uniform ink absorption, etc., across the printable substrate surface. Print mottle may be measured using a scanner based mottle tester such as the C3PATX03 Formation and Mottle Test with an Agfa Model DUOSCAN scanner. The printable substrate (e.g., paper sheet) sample to be tested is first printed on a test ink jet printer. The test pattern must include a block of solid black (100%) image. The color block is a square of about 20-50 mm by 20-50 mm After 20 minutes of waiting time, or when the printed image is fully dried, the printed sample is positioned on the scanner with printed face down. The scanner is set at a resolution of 500 ppi (pixel per inch). A Verity software (Verity IA LLC, 2114 Sunrise Drive, Appleton, Wis. 54914) may be used to analyze the test data from the scanner. An appropriate dimension for testing based on the color block dimension is set. Two mottle indices may be measured: Micro Mottle Index and Macro Mottle Index. The Micro Mottle Index measures density variations within an area of 0.1 in$^2$; while the macro mottle index measures the density variations of the averaged density values of each square of 0.1 in$^2$. The lower the mottle index value, the better the print quality.

For the purposes of the present invention, the term "color-to-color bleed" refers to the spreading of one color ink into another color ink on paper which may reduce the resolution of the colored text and lines on a colored background. For example blue and black bars may be printed over a yellow color background. Green and black bars may be printed over magenta color background, and red and black bars may be printed over cyan color background. The smallest distance in microns between two color bars without bridging (or color intruding more than half way to the neighboring color bar) is recorded as the color-to-color bleed index. In other words, the smaller the value of color-to-color bleed, the better the print quality. Distances which may be tested include 50 microns, 100 microns, 150 microns, 300 microns, etc. In some embodiments of the present invention, the tested distance may reach 150 microns or less before bridging (bleed) occurs, which may be considered a "good" color-to-color bleed property.

For the purposes of the present invention, the term "digital printing" refers to reproducing, forming, creating, providing, etc., digital images on a printable substrate, for example, paper. Digital printing may include laser printing, ink jet printing, etc.

For the purposes of the present invention, the term "laser printing" refers to a digital printing technology, method, device, etc., that may use a laser beam to create, form produce, etc., a latent image on, for example, photoconductor drum. The light of laser beam may later create charge on the drum which may then pick up toner which carries an opposite charge. This toner may then be transferred to the paper and the resulting print image created, formed, produced, etc., fused to the printable substrate through, for example, a fuser.

For the purposes of the present invention, the term "electrophotographic recording process" refers to a process which records images on a printable substrate, such as paper, by xerography or electrophotography. In an electrophotographic process, the image is often formed on of the c by toner particles which are deposited one surface or side of the printable substrate, and are then thermally fixed and/or fused to that one surface or side of the printable substrate, for example, by heating. In electrophotographic recording, the printable substrate may have two relatively smooth or flat sides or surfaces, or may have one side or surface which is textured, uneven or nonsmooth/nonflat, while the other side or surface is relatively smooth or flat.

For the purposes of the present invention, the term "ink jet printing" refers to a digital printing technology, method, device, etc., that may form images on a printable substrate, such as paper, by spraying, jetting, etc., tiny droplets of liquid inks onto the printable substrate through the printer nozzles. The size (e.g., smaller size), precise placement, etc., of the ink droplets may be provide higher quality inkjet prints. Ink jet printing may include continuous ink jet printing, drop-on-demand ink jet printing, etc.

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purposes of the present invention, the term "viscosity," with reference to coating compositions, sizing compositions, etc., refers to Brookfield viscosity. The Brookfield viscosity may be measured by a Brookfield viscometer at 150° F., using a #5 spindle at 100 rpm.

For the purpose of the present invention, the term "printer" refers to any device which prints an image on a printable substrate, such as a paper sheet, including laser printers, inkjet printers, electrophotographic recording devices (e.g., copiers), scanners, fax machines, etc.

For the purpose of the present invention, the term "printer pigment" may refer to either ink (as used by, for example, an inkjet printer, etc.) or toner (as used by, for example, a laser printer, electrographic recording device, etc.).

For the purpose of the present invention, the term "ink" refers printer pigment as used by ink jet printers. The term ink may include dye-based inks and/or pigment-based inks. Dye-based inks comprise a dye which may be an organic molecule which is soluble in the ink medium. Dye-based inks may be classified by their usage, such as acid dyes, basic dyes, or direct dyes, or by their chemical structure, such as azo dyes, which are based on the based on an —N═N— azo structure; diazonium dyes, based on diazonium salts; quinone-imine dyes, which are derivates of quinine, etc. Pigment-based dyes comprise a pigment, which is a solid colored particle suspended in the ink medium. The particle may comprise a colored mineral, a precipitated dye, a precipitated dye which is attached to a carrier particle, etc Inks are often dispensed, deposited, sprayed, etc., on a printable medium in the form of droplets which then dry on the printable medium to form the print image(s).

For the purpose of the present invention, the term "toner" refers printer pigment as used by laser printers. Toner is often dispensed, deposited, etc., on the printable medium in the form of particles, with the particles then being fused on the printable medium to form the image.

For the purpose of the present invention, the term "treating," with reference to multivalent metal drying salt agents, optical brightening agents (OBAs), coating compositions comprising such agents, etc., may include, for example, adding, depositing, applying, spraying, coating, daubing, spreading, wiping, dabbing, dipping, etc., the multivalent metal drying salt agents, optical brightening agents (OBAs), coating compositions comprising such agents, etc., to the surface(s) of the paper substrate.

For the purposes of the present invention, the term "applicator" refers to a device, equipment, machine, etc., which may be used to treat, apply, coat, spray, etc., for example, multivalent metal drying salt agents, optical brightening agents (OBAs), coating compositions comprising such agents, etc., to one or more sides or surfaces of a paper substrate. Applicators may include air-knife coaters, rod coaters, blade coaters, size presses, sprayers, etc. See G. A. Smook, Handbook for Pulp and Paper Technologists ($2^{nd}$ Edition, 1992), pages 289-92, the entire contents and disclosure of which is herein incorporated by reference, for a general description of applicators that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc.

For the purposes of the present invention, the term "metering size press" refers to a size press that includes a component for spreading, metering, etc., deposited, applied, etc., coating composition or coating on a paper substrate side or surface. Metering size presses may include a rod metering size press, a gated roll metering size press, a doctor blade metering size press, etc.

For the purposes of the present invention, the term "rod metering size press" refers to metering size press that uses a rod to spread, meter, etc., the coating composition or coating on the paper substrate surface. The rod may be stationary or movable relative to the paper substrate.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the paper substrate, may rotate relative to the paper substrate, etc.

For the purposes of the present invention, the term "doctor blade metering size press" refers to a metering press which may use a doctor blade to spread, meter, etc., the coating composition or coating on the paper substrate surface.

For the purposes of the present invention, the term "room temperature" refers to the commonly accepted meaning of room temperature, i.e., an ambient temperature of 20° to 25° C.

For the purposes of the present invention, the term "paper substrate surface coverage" refers to amount of the multivalent metal drying salt agents, optical brightening agents (OBAs), coating comprising such agents, etc., present on a given side or surface of the paper substrate being treated. Paper substrate surface coverage may be defined in terms of grams of composition per square meter of paper substrate (hereinafter referred to as "gsm").

For the purposes of the present invention, the term "level of paper sizing" refers to the paper sizing level present in and/or on the paper substrate, and may comprise internal sizing, surface sizing, or both internal sizing and surface sizing.

For the purposes of the present invention, the term "internal sizing" refers to paper sizing present in the paper substrate due to internal paper sizing agents which are included, added, etc., during the papermaking process before a fibrous paper substrate is formed. Internal paper sizing agents generally resist penetration of water or other liquids into the paper substrate by reacting with the paper substrate to make the paper substrate more hydrophobic. Illustrative internal paper sizing agents may include, for example, alkyl ketene dimers, alkenyl succinic anhydrides, etc.

For the purposes of the present invention, the term "surface sizing" refers to paper sizing present in the paper substrate due to surface paper sizing agents which are applied on, added to, etc., the surface of the formed fibrous paper substrate. Surface paper sizing agents generally resist penetration of water or other liquids into the paper substrate by covering the paper substrate with a more hydrophobic film. Illustrative surface paper sizing agents may include, for example, starch, modified starch, styrene maleic anhydride copolymers, styrene acrylates, etc.

For the purposes of the present invention, the term "optical brightener agent (OBA)" refers to certain fluorescent materials which may increase the brightness (e.g., white appearance) of paper substrate surfaces by absorbing the invisible portion of the light spectrum (e.g., from about 340 to about 370 nm) and converting this energy into the longer-wavelength visible portion of the light spectrum (e.g., from about 400 to about 500 nm). In other words, the OBA converts invisible ultraviolet light and re-emits that converted light into blue to blue-violet light region through fluorescence. OBAs may also be referred to interchangeably as fluorescent whitening agents (FWAs) or fluorescent brightening agents (FBAs). The use of OBAs is often for the purpose of compensating for a yellow tint or cast of paper pulps which have, for example, been bleached to moderate levels. This yellow tint or cast is produced by the absorption of short-wavelength light (violet-to-blue) by the paper substrate. With the use of OBAs, this short-wavelength light that causes the yellow tint or cast is partially replaced, thus improving the brightness and whiteness of the paper substrate. OBAs are desirably optically colorless when present on the paper substrate surface, and do not absorb light in the visible part of the spectrum. These OBAs are anionic and may include one or more of: 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides, etc. See, for example, commonly assigned U.S. Pat. No. 7,381,300 (Skaggs et al.), issued Jun. 3, 2008; U.S. Pat. No. 7,622,022 (Skaggs et al.), issued Nov. 24, 2009; U.S. Pat. No. 7,972,477 (Skaggs et al.), issued Jul. 5, 2011; U.S. Pat. Appln. No. 20090317549 (Tan et al.), published Dec. 24, 2009; and, U.S. Pat. Appln. No. 20100129553 (Jackson et al.), published May 27, 2010, the entire contents and disclosures of which are herein incorporated by reference, which discloses OBAs which may be suitable in embodiments of the process of the present invention. In particular, these OBAs may comprise, for example, one or more stilbene-based sulfonates (e.g., disulfonates, tetrasulfonates, or hexasulfonates) which may comprise one or two stilbene residues. Illustrative examples of such anionic stilbene-based sulfonates may include 1,3,5-triazinyl derivatives of 4,4'-diaminostilbene-2,2'-disulphonic acid (including salts thereof), and in particular the bistriazinyl derivatives (e.g., 4,4-bis(triazine-2-ylamino)stilbene-2,2'-disulphonic acid), the disodium salt of distyrlbiphenyl disulfonic acid, the disodium salt of 4,4'-di-triazinylamino-2,2'-di-sulfostilbene, etc. Commercially available disulfonate, tetrasulfonate and hexasulfonate stilbene-based OBAs may also be obtained, for example, from BASF under the trademark TINOPAL®, from Clariant under the trademark LEUCOPHOR®, from Blankophor under the trademark BLANKOPHOR®, and from 3V under the trademark OPTIBLANC®.

For the purposes of the present invention, the term "brightness" refers to the diffuse reflectivity of paper, for example, at a mean wavelength of light of 457 nm. As used herein, brightness of the paper substrate may be measured in terms of ISO Brightness which measures brightness using, for example, an ELREPHO Datacolor 450 spectrophotometer, according to test method ISO 2470-1, using a C illuminant with UV included. For embodiments of ground paper substrates of the present invention, an ISO Brightness value of at least about 75 is considered an acceptable degree of brightness. In some embodiments of groundwood paper substrates of the present invention, the ISO Brightness value may be at least about 85, for example, at least about 90. For embodiments of ground paper substrates of the present invention, an ISO Brightness value of at least about 90 is considered an acceptable degree of brightness. In some embodiments of free paper substrates of the present invention, the ISO Brightness value may be at least about 94, for example, at least about 96. (Brightness may also be measured in terms of TAPPI Brightness, for example, TAPPI Test Method T452.)

For the purposes of the present invention, the term "whiteness" refers to the white impression of paper, normally favoring a bluish cast or tint. As used herein, whiteness of the paper substrate may be measured in terms of CIE Whiteness which measures whiteness using, for example, an ELREPHO Datacolor 450 spectrophotometer, according to test method ISO 11475, using a D65 outdoor illuminant. For embodiments of groundwood paper substrates of the present invention, a CIE Whiteness value of at least about 100 is considered an acceptable degree of brightness. In some embodiments of ground paper substrates of the present invention, the CIE Whiteness value may be at least about 105, for example, at least about 115. For embodiments of free paper substrates of the present invention, a CIE Whiteness value of at least about 115 is considered an acceptable degree of brightness. In some embodiments of free paper substrates of the present invention, the CIE Whiteness value may be at least about 125, for example, at least about 145.

For the purposes of the present invention, the term "quenching" refers to the diminishing, decreasing, reducing, extinguishing, etc., of the fluorescence of OBAs by other cationic molecules, compounds, etc. Cationic molecules which may cause quenching of the fluorescence of OBAs include multivalent metal drying salts, such as calcium chloride.

DESCRIPTION

Embodiments of the process of the present invention provide printable substrates which solve the problem of diminished, decreased, reduced, etc., paper brightening obtained with, for example, stilbene-based optical brightening agents (OBAs) when multivalent metal salts, such as calcium chloride, are added with such OBAs simultaneously, concurrently, etc., for example, at a size press. Multivalent metal salt drying agents, such as calcium chloride, may be used as the metal salt drying agent to improve the ink dry time and print density of paper substrates. But, because OBAs have an anionic (negative) charge, these anionic molecules are electrostatically attracted to multivalent cationic (positively charged) molecules, such as the divalent calcium ion of calcium chloride. This attraction of, and interaction between, anionic OBAs and multivalent cationic metal ions, such as divalent cationic metal ions (e.g., the calcium ions of calcium chloride), may interfere with the fluorescence of the OBAs. Such interference often occurs in such a way that the fluorescence of the OBAs may be partially or completely quenched, and thus the OBAs may lose their ability to impart an optical brightening effect to the paper substrate surface. As a result, the optical brightening of the OBA may be significantly diminished, decreased, etc., by the concurrent or simultaneous addition with multivalent metal salt drying agents, such as calcium chloride, including to the point that the OBAs may impart insufficient optical brightness to the paper substrate surface.

Inclusion of these multivalent metal salts to these size press coating composition may have not only a quenching effect on the OBAs, but may also increase the "greening" effect (i.e., increase in the amount of green tint) imparted to a paper sheet by such sizing compositions containing comparable amounts of OBAs. Previously, these quenching and "greening" effects might be compensated for by adding more OBA(s) and tinting dyes. But increasing the amount of added OBA(s) may also cause an undesired a "green over" effect if an excess of OBA(s) is present, thus necessitating compensation through addition of tinting dyes which then reduce the achievable brightness/whiteness for the paper sheet. This "green over" effect is due to the "yellow" color of the excess OBA(s) optically blending with the blue/violet light reflected by the OBA(s) (in fluorescing) to thus impart a "greenish" tint, shade, hue, etc., to the paper substrate surface.

Embodiments of the process of the process of the present invention provide printable substrates having improved brightness (by using OBAs) in combination with improved dry time (by using multivalent metal drying salt agents), but without incurring adverse effects caused by simultaneously or concurrently adding such agents, such as partial or complete quenching of the OBA(s), increasing the amount of OBA(s) to the extent of creating "green over" effects, etc. These benefits may be achieved in embodiments of the present invention by treating one or both surfaces of a paper substrate at the size press with either an optical brightening agent or a multivalent metal salt drying agent, but not both of these two agents. Instead, before or after the surface(s) of the paper substrate is treated with one of these two agents, the surface(s) is treated with the other of these two agents to provide the printable substrate wherein: (1) the multivalent metal salt drying agent in an amount such that the at least one surface has a percent ink transferred ("IT %") value equal to or less than about 65% and a black print density value of at least about 1.15; and (2) the optical brightening agent is present in an amount sufficient to impart to the at least one surface an ISO brightness value of at least about 90 (for "free" paper substrates comprising about 10% or less by weight mechanical pulp fibers), or an ISO brightness value of at least about 75 (for "groundwood" paper substrates" comprising greater than about 10% by weight mechanical pulp fibers).

By treating the surface(s) of the paper substrate with each of these two agents at separate and different points (i.e., one agent added at the size press, the other agent added at a point before or after the size press), embodiments of the process of the present invention minimize, reduce, inhibit, avoid, eliminate, prevent, etc., the undesired interactions between the OBAs and the multivalent metal salt drying agents. In some embodiments, the OBAs may be added to the surface(s) of the paper substrate at the size press, while the multivalent metal drying salt agent(s) are added to the paper substrate (e.g., by spraying) before or after the size press. In such embodiments, a higher concentration of multivalent metal drying salt agent (compared to the OBA) may be used, thus permitting a lower overall amount of such multivalent metal salt drying agent(s) to be applied to the surface(s) of the paper substrate, and thus potentially decreasing the amount of drying required of the treated paper substrate. In such embodiments, applying such multivalent metal salt drying agent(s) to the surface(s) of the paper substrate at, for example, before the size press may also avoid certain dryer requirements if the OBAs were applied separately as relatively dilute solutions from the size press formulation. In addition, by adding multivalent metal salt drying agent(s) (such as calcium chloride) to the paper substrate at other than at the size press in such embodiments, the tendency of such drying agents to make salts with fatty acids present in starch (which may be present in the sizing composition applied at the size press) which may precipitate and fall out of solution (thus potentially causing undesired contamination of the paper substrate and/or clogging of machines and/or apparatuses responsible for delivering the calcium chloride, starch, and optical brightening agent(s) to the paper substrate) may also be avoided.

In other embodiments, the multivalent metal drying salt agent(s) may be added to the surface(s) of the paper substrate at the size press, while the OBAs are added to the paper substrate (e.g., by spraying) before or after the size press. In such embodiments where the OBAs are applied after the size press, the OBAs would form an outer coating, layer, etc., of the treated surface(s) of the paper substrate, thus protecting that treated surface(s) from yellowing. Adding the OBA(s) to the surface(s) of the paper substrate other than at the size press may also provide more efficient brightening for the paper substrate.

The OBAs or multivalent metal salt drying agent(s) may be applied before or after the size press by various techniques, methods, etc. For example, in some embodiments, the OBAs or multivalent metal salt drying agent(s) may be applied before or after the size press by spraying. In such embodiments, spraying may be carried out by airless spraying, atomized spraying, high vacuum/low pressure (HVLP) spraying, air assisted airless spraying, rotary spraying, etc. In one such embodiment, the calcium chloride as the multivalent metal salt drying agent may be sprayed onto the surface(s) of the paper substrate before the size press, with the OBA(s) being applied at the size press. In another such embodiment, the calcium chloride may be sprayed onto the surface(s) of the paper substrate after the size press, with the OBA(s) being applied at the size press. In yet another such embodiment, the calcium chloride may be applied at the size press, with the OBA(s) being sprayed after the size press to provide an outer coating, layer, etc., which may be more resistant, protective against, etc., yellowing of the surface(s).

When treated with the OBA(s), the OBA pickup on one or both paper substrate surfaces is in amount sufficient to impart an ISO Brightness value of at least about 75 (e.g., at least about 85, such as at least 90). For example, a pickup of from about 0.25 to about 3 wt % of the OBA(s) (such as the stilbene-based sulfonates) per ton of paper substrate (e.g., from about 1 to about 2 wt % of the OBA(s) per ton of paper substrate) on each surface of the paper substrate is sufficient to impart these ISO Brightness values. In addition to imparting an ISO Brightness value of at least about 90 (for "free" paper substrates), or at least about 75 (for "groundwood" paper substrates), these coverages with the OBA(s) may also impart a CIE Whiteness value to the paper substrate surfaces of at least about 115 (for "free" paper substrates), or at least about 100 for "groundwood" paper substrates). When treated with the multivalent metal salt drying agent(s), the pickup may be from about 0.15 to about 3% by weight per ton of paper substrate, such as, from about 0.35 to about 1.3% by weight per ton of paper substrate.

One embodiment of a process of the present invention for treating one or both surfaces of the paper substrate two separate coating compositions, one comprising the multivalent metal salt drying agent(s), the other comprising the OBAs (plus any other optional ingredients, such as starch, other surface sizing agents, surfactant, latex, coating defoamers, etc.) is further illustrated in FIG. 1. Referring to FIG. 1, an embodiment of a system for carrying out such an embodiment of the process of the present invention is indicated generally as 100. System 100 may be used to apply separately apply a coating composition comprising a multivalent metal salt drying agent(s) and coating composition comprising an OBA(s) to a paper substrate, indicated generally as 104. Substrate 104 moves in the direction indicated by arrow 106, and which has a pair of opposed sides or surfaces, indicated, respectively, as 108 and 112.

System 100 includes a size press station (which is illustrated in FIG. 1, for example, as being metering rod size press), which is indicated generally as 114. Size press station 116 includes a lower first assembly, indicated generally as 116, for applying the coating composition to surface 108. Assembly 116 includes a first reservoir, indicated generally as 120, provided with a supply of a first coating composition, indicated generally as 124. A first take up roll, indicated generally as 128 which may rotate in a counterclockwise direction, as indicated by curved arrow 132, picks up an amount of a first coating composition from supply 124. This amount of first coating composition 124 that is picked up by rotating roll 128 may then be transferred to a first applicator roll, indicated generally as 136, which rotates in the opposite and clockwise direction, as indicated by curved arrow 140. (The positioning of first take up roll 128 shown in FIG. 1 is simply illustrative and roll 128 may be positioned in various ways relative to first applicator roll 136 such that first coating composition 124 is transferred to the surface of first applicator roll 136.) The amount of the first coating composition that is transferred to first applicator roll 136 may be controlled by a first metering rod 144 which spreads the transferred first coating composition on the surface of first applicator roll 136, thus providing relatively uniform and consistent thickness of a first surface coating, indicated as 148, of first coating composition 124 when applied onto the first surface 108 of substrate 104 by first applicator roll 136.

As shown in FIG. 1, size press 114 may also be provided with an upper second assembly indicated generally as 152, for applying the first coating composition to surface 112. Assembly 152 includes a second reservoir, a second supply of the first coating composition, and a second take up roll (similar to reservoir 120, supply 124, and take up roll 132) which is indicated generally by the dashed-line box and arrow 156. As shown in FIG. 1, the amount of the first coating composition that is transferred from second supply reservoir/second take-up roll 156 to second applicator roll 160 (which rotates in a clockwise direction, as indicated by curved arrow 164) may be controlled by a second metering rod 168 which spreads the transferred first coating composition on the surface of applicator roll 160, thus providing relatively uniform and consistent thickness of a second surface coating of the first coating composition, indicated as 172, when applied onto second surface 112 of substrate 104 by second applicator roll 164.

As further shown in FIG. 1, system 100 is also provided with a spray station, indicated generally as 176 which is positioned after size press station 116. Spray station 176 comprises a lower first sprayer 180 and an upper second sprayer 184. First sprayer 180 applies (sprays) a second coating composition onto first surface coating 148, thus providing a first outer coating 188 of the second coating composition over surface 108. Second sprayer 184 also applies (sprays) the second coating composition onto second surface coating 148, thus providing a second outer coating 192 of the second coating composition over surface 112.

In system 100, surface coatings 148 and 172 applied by size press station 114 may be one of the multivalent metal salt drying agent(s) or the OBA(s), while outer coatings 188 and 192 applied by spray station 176 may the other of the multivalent metal salt drying agent(s) or the OBA(s). For example, in one embodiment, surface coatings 148 and 172 applied by size press station 114 may comprise the multivalent metal salt drying agent(s), while outer coatings 188 and 192 applied by spray station 176 may comprise the OBA(s). Alternatively, in another embodiment, first coatings 148 and 172 applied by size press station 114 may comprise the OBA(s), while outer coatings 188 and 192 applied by spray station 176 may comprise the multivalent metal salt drying agent(s).

Figure 2:
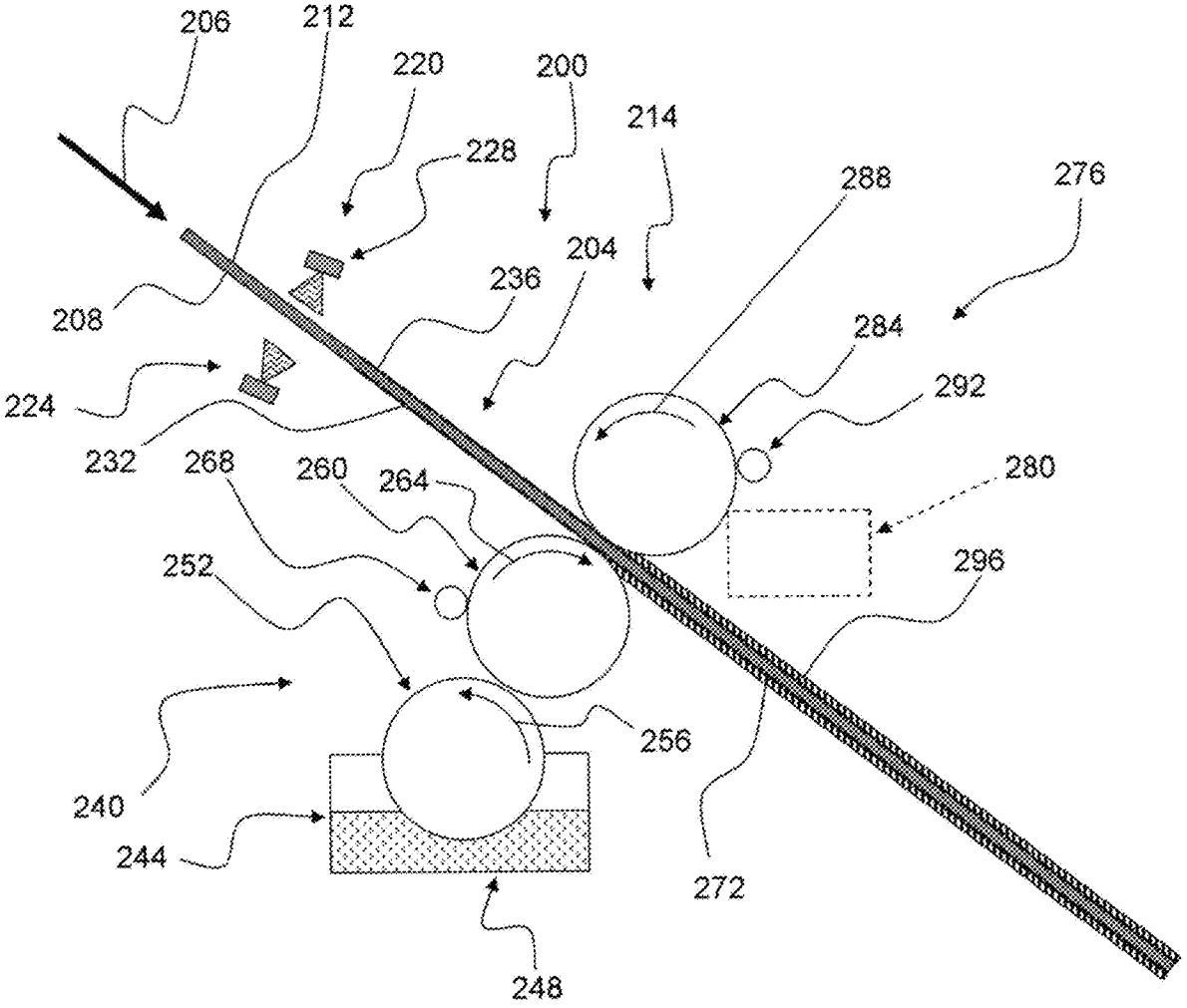
FIG. 2 is a schematic diagram of a system for carrying out another embodiment of a process for treating one or both surfaces of a paper substrate separately with the multivalent salt metal drying agent and the optical brightening agent, but wherein the order of treatment is reversed, i.e., by first using spray station to apply one of the two agents, followed by using a size press station to apply the other of the two agents.

Another embodiment of a process of the present invention for treating one or both surfaces of the paper substrate with the two separate coating compositions, is illustrated in FIG. 2. Referring to FIG. 2, an embodiment of a system for carrying out such an alternative embodiment of the process of the present invention is indicated generally as 200. System 200 may also be used to apply separately apply a coating composition comprising a multivalent metal salt drying agent(s) and coating composition comprising an OBA(s) to a paper substrate, indicated generally as 204. Substrate 204 moves in the direction indicated by arrow 206, and which has a pair of opposed sides or surfaces, indicated, respectively, as 208 and 212.

System 200 also includes a size press station (which is again illustrated in FIG. 2, for example, as being metering rod size press), which indicated generally as 214. But unlike system 100, system 200 has a spray station 220 which is positioned before size press station 216. Like spray station 176 of system 100, spray station 220 comprises a lower first sprayer 224 and an upper second sprayer 228. First sprayer 224 applies (sprays) a first coating composition onto surface 208, thus providing a first surface coating 232 of the first coating composition on surface 208. Second sprayer 228 also applies (sprays) the first coating composition onto the second surface 212, thus providing a second surface coating 236 of the first coating composition on surface 212.

Like size press station 114, size press station 214 includes a lower first assembly, indicated generally as 240, for applying the coating composition onto first surface coating 232. Assembly 240 includes a first reservoir, indicated generally as 244, provided with a supply of a second coating composition, indicated generally as 248. A first take up roll, indicated generally as 252 which may rotate in a counter-clockwise direction, as indicated by curved arrow 256, picks up an amount of a second coating composition from supply 248. This amount of second coating composition 248 that is picked up by rotating roll 252 may then be transferred to a first applicator roll, indicated generally as 260, which rotates in the opposite and clockwise direction, as indicated by curved arrow 264. (The positioning of first take up roll 252 shown in FIG. 2 is again simply illustrative and roll 252 may be positioned in various ways relative to first applicator roll 260 such that the second coating composition is transferred to the surface of first applicator roll 260.) The amount of second coating composition 248 that is transferred to first applicator roll 260 may be controlled by first metering rod 268 which spreads the transferred second coating composition on the surface of applicator roll 260, thus providing relatively uniform and consistent thickness of a first outer coating of the second coating composition, indicated as 272, when applied by applicator roll 260 onto first surface coating 232.

As shown in FIG. 2, size press 214 may also be provided with an upper second assembly indicated generally as 276, for applying the second coating composition onto first coating 232. Assembly 276 includes a second reservoir, a second supply of the second coating composition, and a second take up roll (similar to reservoir 244, supply 248, and take up roll 256) which is indicated generally by the dashed-line box and arrow 280. As shown in FIG. 2, the amount of the second coating composition that is transferred from second supply reservoir/second take-up roll 280 to second applicator roll 284 (which rotates in a clockwise direction, as indicated by curved arrow 288) may be controlled by a second metering rod 292 which spreads the transferred second coating composition on the surface of second applicator roll 284, thus providing relatively uniform and consistent thickness of a second outer coating of the second coating composition, indicated as 296, when applied by second applicator roll 284 onto second surface coating 236.

In system 200, surface coatings 232 and 236 applied by spray station 220 may be one of the multivalent metal salt drying agent(s) or the OBA(s), while outer coatings 272 and 296 applied by size press station 214 may the other of the multivalent metal salt drying agent(s) or the OBA(s). For example, in one embodiment, surface coatings 232 and 236 applied by spray station 220 may comprise the multivalent metal salt drying agent(s), while outer coatings 272 and 296 applied by size press station 214 may comprise the OBA(s). Alternatively, in another embodiment, surface coatings 232 and 236 applied by spray station 220 may comprise the OBA(s), while outer coatings 272 and 296 applied by spray station 214 may comprise the multivalent metal salt drying agent(s).

EXAMPLES

Compositions comprising calcium chloride as the multivalent metal salt drying agent ($CaCl_2$ Composition), a stilbene-based hexasulfonate (Leucophor SUS hexasulphonated from Clariant) as the OBA (OBA Composition), or a mixture of the calcium chloride and the OBA (Mixed Composition) are prepared.

Eight runs are carried out (R1 through R8) using a free paper substrate, i.e., less than about 1% by weight mechanical pulp fibers. Runs R1 through R3 involve treating the paper substrate with the Mixed Composition at the size press. Run R4 is the control run where the paper substrate is treated solely with the OBA Composition at the size press (i.e., no application of calcium chloride). For runs R5 through R8, the paper substrate is treated with the OBA Composition at the size press, and is then sprayed on one side of the paper substrate with varying levels of the $CaCl_2$ Composition.

The Mixed Compositions used in runs R1 through R3 are formulated with starch (74.6 wt % total solids basis), water, OBA (22.4 wt % total solids basis) and varying levels of $CaCl_2$ (approximately 3.0 wt %, 6.0 wt % and 9.0 wt % total solids basis, respectively, see Table 1 below for runs R1, R2, and R3). All of the components of the Mixed Compositions are added together in a mix tank, and then delivered to the size press.

For runs R4 through R8, the OBA Composition is formulated with starch (76.9 wt % total solids basis) and OBA (23.1 wt % total solids basis), and then delivered to the size press. The $CaCl_2$ Composition used in runs R5 through R8 is formulated as a dilute solution of calcium chloride at approximately 5 wt % (solids basis in the solution) for spray application, and then applied at a range of liquid flows through a spray nozzle to provide various pickup coverage amounts up to 8.4 pounds per ton of paper (see R5 through R8 in Table 1 below) on a moving web of paper substrate.

For each of runs R1 through R8, the batch temperature for the Mixed and OBA Compositions is maintained at 160° F. before delivery to the size press (i.e., a flooded nip size press, which is illustrative). For runs R5 through R8, the spray solution is applied (after the size press nip) to one side of the paper substrate using an atomized spray nozzle with a flowmeter to monitor and control dosage rates.

The OBA dosage (OBA Dose), calcium chloride dosage ($CaCl_2$ Dose) and the point where calcium chloride is added ($CaCl_2$ Addition Point) to the paper substrate for each of runs R1 through R8 are shown in Table 1 below:

TABLE 1

| Run | OBA Dose[1] | $CaCl_2$ Dose[2] | $CaCl_2$ Addition Point |
|---|---|---|---|
| R1 | 30 | 2.5 | Size Press |
| R2 | 30 | 5.1 | Size Press |
| R3 | 30 | 10 | Size Press |
| R4 | 30 | 0.0 | No Spray |
| R5 | 30 | 0.1 | Spray |
| R6 | 30 | 2.7 | Spray |
| R7 | 30 | 6.8 | Spray |
| R8 | 30 | 8.4 | Spray |

[1]Lbs. of OBA per ton of paper substrate
[2]Lbs. of $CaCl_2$ per ton of paper substrate As test paper sheets for runs R1 through R8 are completed, those test sheets are cut from the machine roll and measured using a color spectrophotometer to gauge impact of various application/dosing methods on optical parameters and print density, as recorded in Table 2 below. Dosages of OBA and calcium chloride applied in each of runs R-1 through R-8, as well as the color values (L*, a*, and b*), CIE Whiteness (CIE), ISO Brightness (ISO), and optical density (OD) which are obtained, are shown in Table 2 below:

TABLE 2

| Run | L* | a* | b* | CIE | ISO | OD | OBA Dosage[1] | $CaCl_2$ Dosage[2] |
|---|---|---|---|---|---|---|---|---|
| R-1 | 94.84 | −0.19 | −0.09 | 118.83 | 91.67 | 1.04 | 30 | 2.5 |
| R-2 | 94.93 | −0.19 | 0.06 | 118.20 | 91.75 | 1.27 | 30 | 5.1 |
| R-3 | 94.92 | −0.24 | 0.08 | 118.54 | 91.77 | 1.37 | 30 | 10 |
| R-4 | 94.84 | −0.01 | 0.14 | 117.28 | 91.15 | 0.84 | 30 | 0 |
| R-5 | 94.84 | −0.09 | 0.22 | 116.41 | 91.20 | 0.94 | 30 | 0.1 |
| R-6 | 94.88 | −0.11 | 0.11 | 117.62 | 91.53 | 1.25 | 30 | 2.7 |
| R-7 | 94.92 | −0.22 | 0.03 | 120.04 | 92.04 | 1.41 | 30 | 6.8 |
| R-8 | 94.92 | −0.27 | −0.01 | 120.12 | 92.07 | 1.42 | 30 | 8.4 |

[1]Lbs. of OBA per ton of paper substrate

[2]Lbs of calcium chloride per ton of paper substrate

Figure 3:
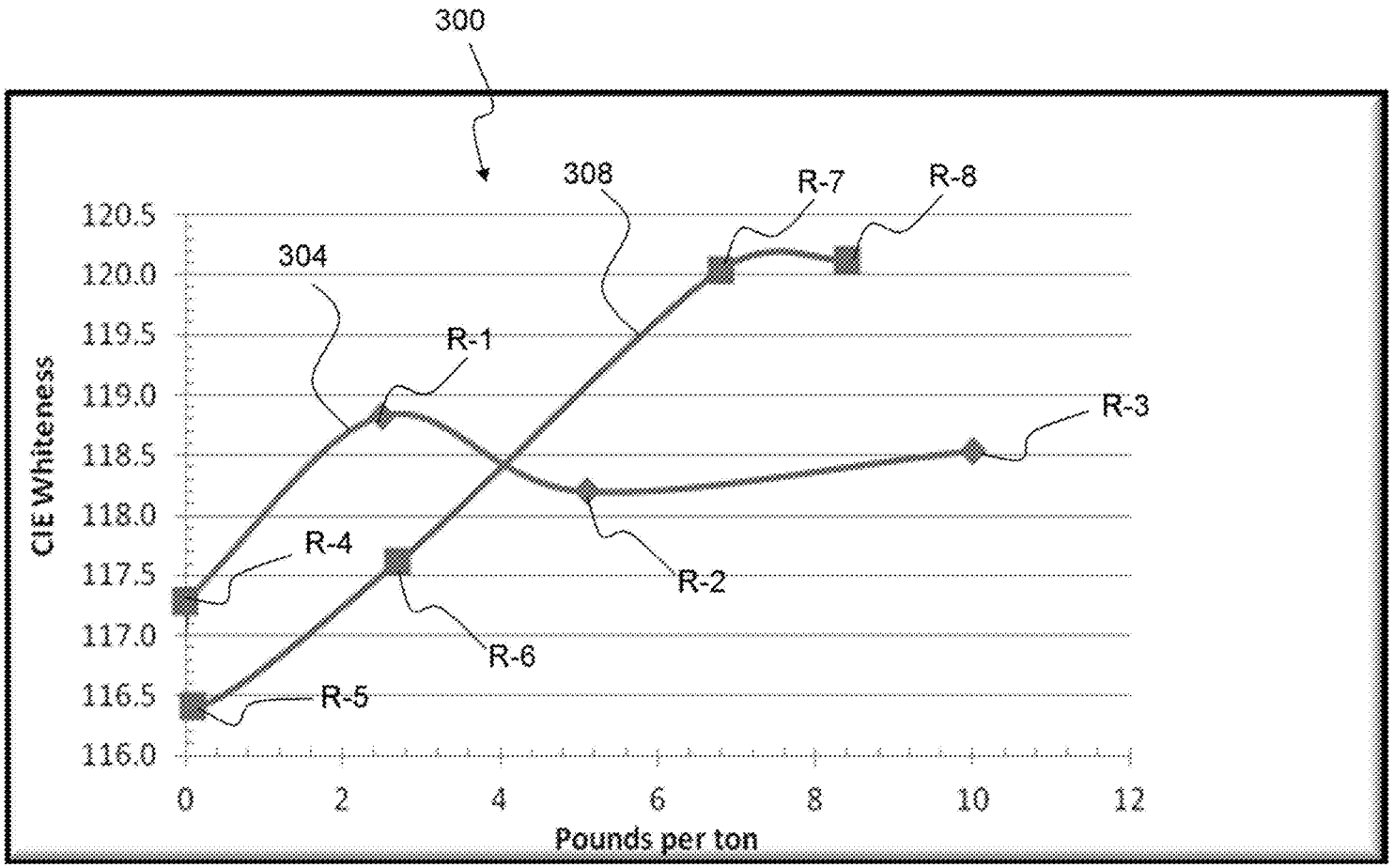
FIG. 3 is a graphical plot of the CIE values versus actual calcium chloride dosage (in lbs per ton of paper substrate) of eight runs (R-1 through R-8) involving applying separate compositions comprising either a multivalent metal salt drying agent or an optical brightening agent (OBA), or applying a composition comprising a mixture of the multivalent metal salt drying agent and OBA.

The CIE, ISO, a*, and OD values from Table 2 above for each of runs R-1 through R-8 are graphically plotted, as shown in FIGS. 3-6. FIG. 3 is a graphical plot, indicated generally as 300, of the CIE Whiteness values versus the actual calcium chloride dosage (in lbs per ton of paper substrate). The CIE Whiteness values for runs R-1 through R-3 are plotted as curve 304, while the CIE Whiteness values for runs R-4 through R-8 are plotted as curve 308. Graphical plot 300 shows that calcium chloride applied by spray separate from the OBA (i.e., runs R5 through R8) continues to increase visual appeal of the treated paper substrate (i.e., CIE Whiteness) over size press applications containing combined OBA and calcium chloride. This increase in visual appeal is applicable to calcium chloride dosages above 4 pounds per ton of paper substrate (i.e., compare runs R7 and R8 to runs R2 and R3 in FIG. 3).

Figure 4:
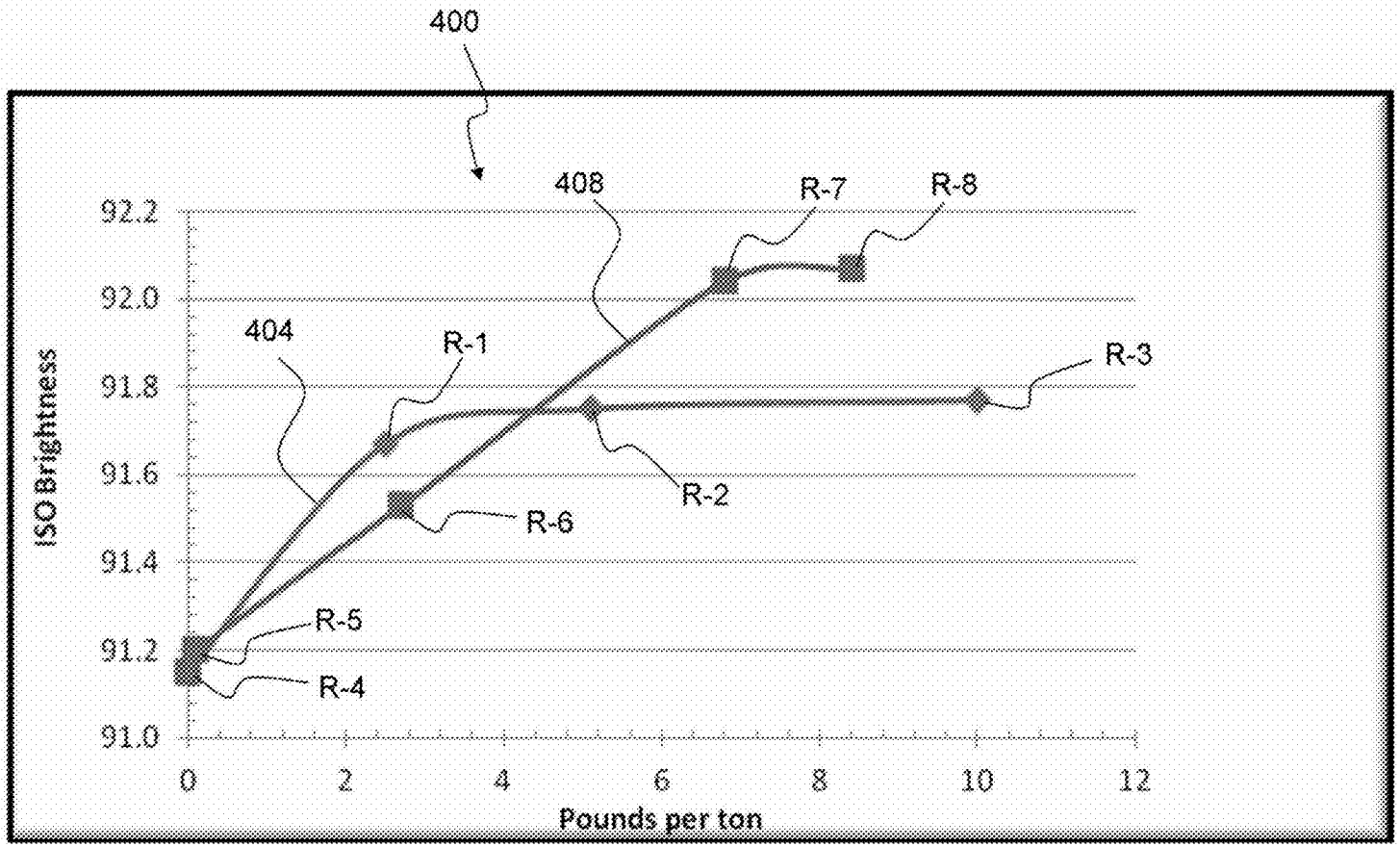
FIG. 4 is a graphical plot of the ISO values versus actual calcium chloride dosage (in lbs per ton of paper substrate) of eight runs (R-1 through R-8) involving applying separate compositions comprising either a multivalent metal salt drying agent or an OBA, or applying a composition comprising a mixture of the multivalent metal salt drying agent and OBA.

FIG. 4 is a graphical plot, indicated generally as 400, of the ISO values versus the actual calcium chloride dosage (in lbs per ton of paper substrate). The ISO values for runs R-1 through R-3 are plotted as curve 404, while the ISO values for runs R-4 through R-8 are plotted as curve 408. Much like CIE Whiteness, graphical plot 400 shows the visual appeal of the treated paper substrate is increased by spray application of calcium chloride separate from the OBA. Graphical plot 400 also shows that ISO Brightness continues to increase at calcium chloride dosages above 4 pounds per ton of paper substrate with spray application of the calcium chloride separate from the OBA (compare runs R7 and R8 to runs R2 and R3 in FIG. 4).

Figure 5:
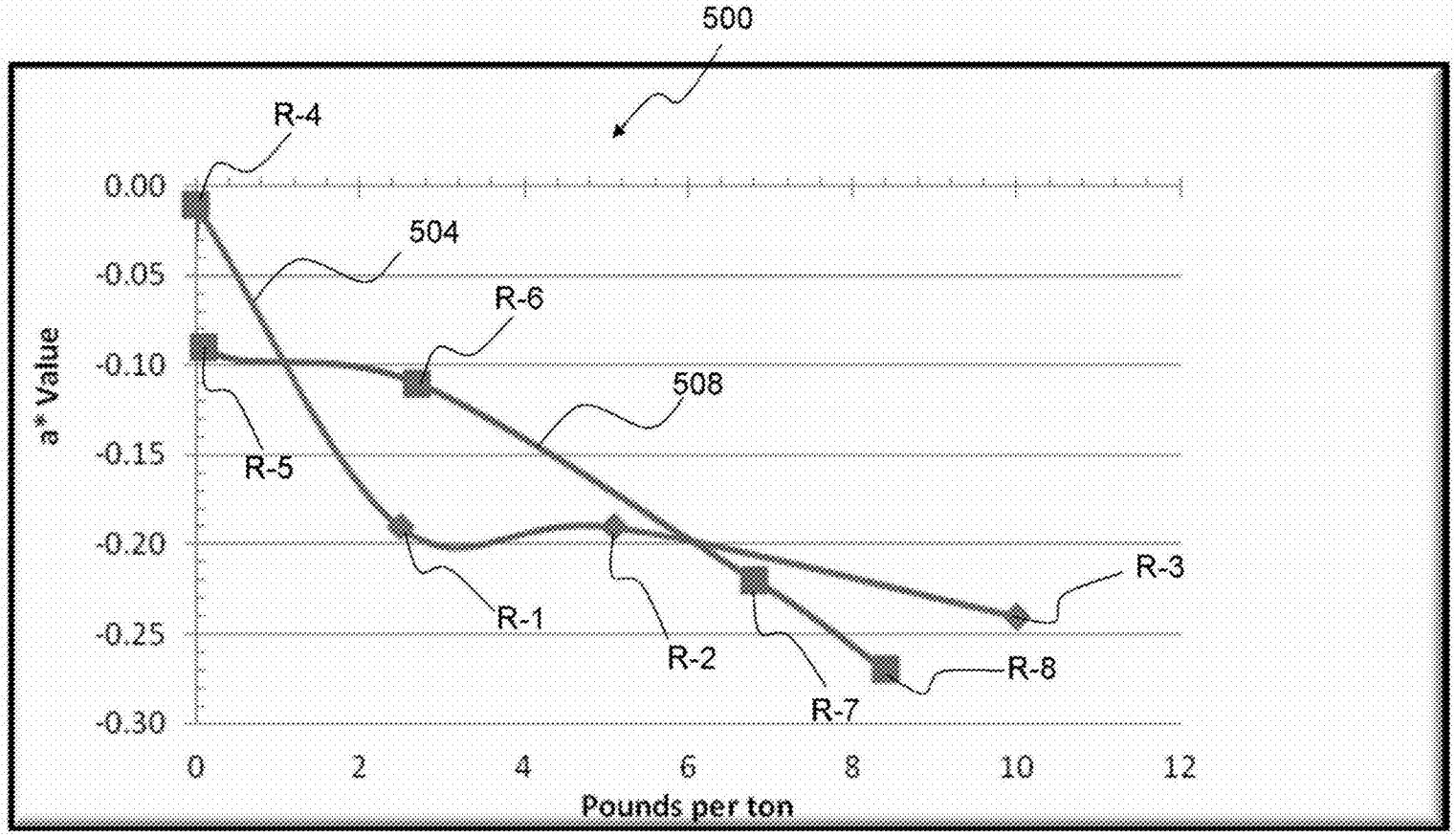
FIG. 5 is a graphical plot of the a* values versus actual calcium chloride dosage (in lbs per ton of paper substrate) of eight runs (R-1 through R-8) involving applying separate compositions comprising either a multivalent metal salt drying agent or an OBA, or applying a composition comprising a mixture of the multivalent metal salt drying agent and OBA.

FIG. 5 is a graphical plot, indicated generally as 500, of the a* values versus the actual calcium chloride dosage (in lbs per ton of paper substrate). The a* values for runs R-1 through R-3 are plotted as curve 504, while the a* values for runs R-4 through R-8 are plotted as curve 508. These a* values (red when positive and green when negative) represent an uncorrected color measurement of the treated paper substrate after application of the calcium chloride. As shown by graphical plot 500, spray application of calcium chloride separate from the OBA shows a lower tendency for the treated paper substrate to move towards a greener shade, thus no longer requiring color correction in the paper manufacturing process. (If dyes are added for color correction, the treated paper substrate may darken, thus reducing overall visual appeal.) This lower tendency to shift to greener shades is reflected in the CIE Whiteness and ISO Brightness measured values of FIGS. 3 and 4, as shown in graphical plots 300 and 400, respectively.

Figure 6:
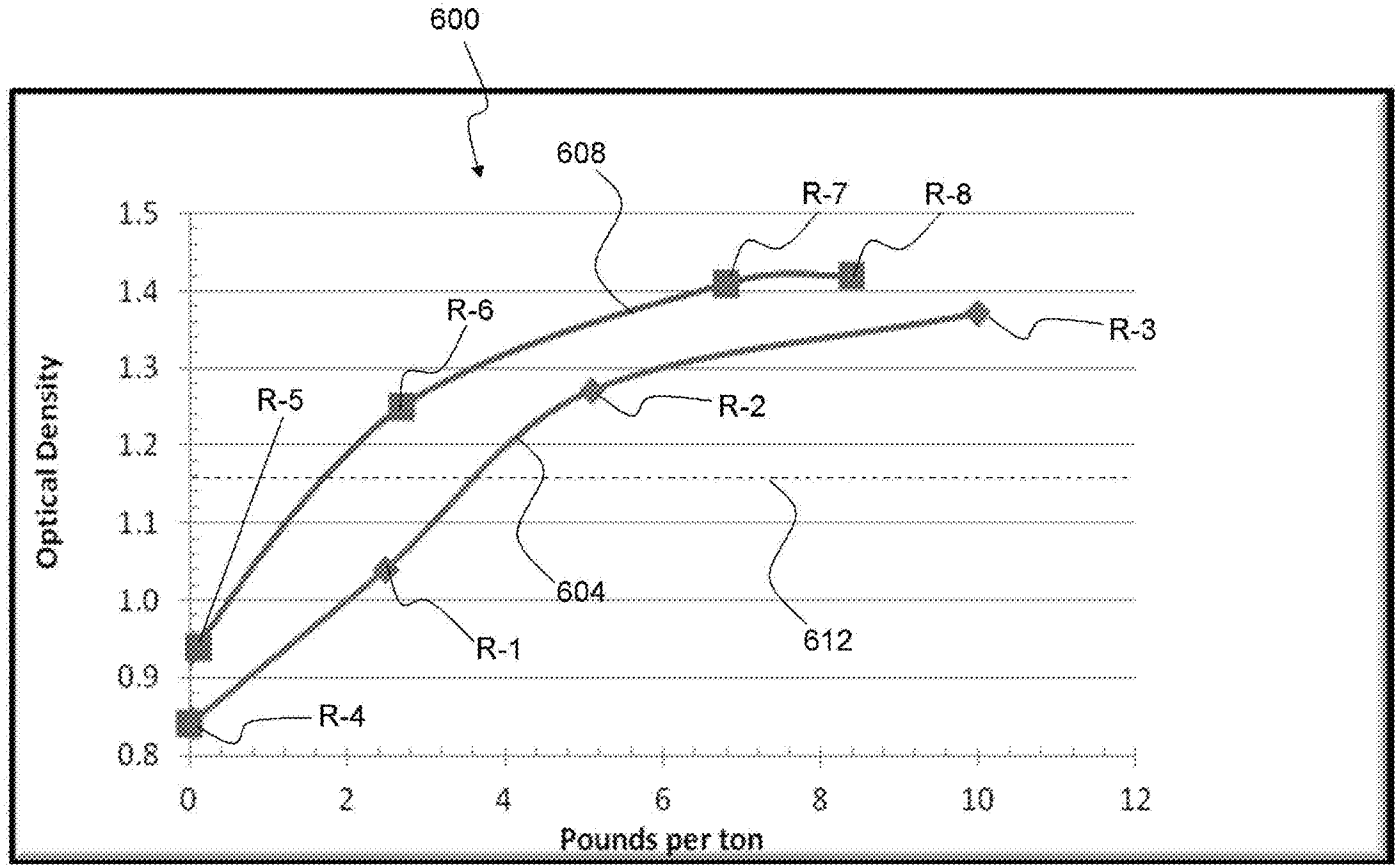
FIG. 6 is a graphical plot of the optical density (OD) values versus actual calcium chloride dosage (in lbs per ton of paper substrate) of eight runs (R-1 through R-8) involving applying separate compositions comprising either a multivalent metal salt drying agent or an OBA, or applying a composition comprising a mixture of the multivalent metal salt drying agent and OBA.

FIG. 6 is a graphical plot, indicated generally as 600, of the OD values versus the actual calcium chloride dosage (in lbs per ton of paper substrate). The OD values for R-1 through R-3 are plotted as curve 604, while the OD values for R-4 through R-8 are plotted as curve 608. Dashed horizontal line 612 indicates at least a minimally acceptable OD value (i.e., about 1.15 or greater). The OD values may be used to illustrate the improvement in print density performance caused by treatment of the paper substrate with calcium chloride. At every comparable dosage level, graphical plot 600 shows that the sprayed application of calcium chloride separate from the OBA provides better print density performance relative to inclusion of calcium chloride with the OBA (i.e., Mixed Compositions) at the size press.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. A process comprising the following steps:

(a) for a paper substrate comprising about 10% or less by weight mechanical pulp fibers and having a first surface and a second surface, treating at least one of the first and second surfaces at a size press with one of the following two agents: (1) an optical brightening agent; or (2) a multivalent metal salt drying agent, to provide a treated paper substrate having one of the two agents; and (b) before or after the size press, treating the at least one surface of the paper substrate of step (a) with the other of the two agents to provide a printable substrate;

(c) wherein the least one surface after steps (a) and (b) comprises the multivalent metal salt drying agent in an amount such that the at least one surface has a black print density value of at least about 1.15;

(d) wherein the optical brightening agent is present after steps (a) and (b) in an amount sufficient to impart to the at least one surface an ISO brightness value of at least about 75.

2. The process of claim 1, wherein steps (a) and (b) are carried out on both the first and second surfaces.

3. The process of claim 2, wherein the first and second surfaces are treated with the multivalent metal salt drying agent at a pickup of from about 0.15 to about 3% by weight of the multivalent metal salt drying agent per ton of paper substrate.

4. The process of claim 3, wherein the first and second surfaces are treated with the multivalent metal salt drying agent at a pickup of from about 0.35 to about 1.3% by weight of the multivalent metal salt drying agent per ton of paper substrate.

5. The process of claim 2, wherein the first and second surfaces are treated with the optical brightening agent at a pickup 0.25 to about 3% by weight of the optical brightening agent per ton of paper substrate.

6. The process of claim 5, wherein the first and second surfaces are treated with the optical brightening agent at a pickup of from about 1 to about 2% by weight of the optical brightening agent per ton of paper substrate.

7. The process of claim 1, wherein the multivalent metal salt drying agent comprises one or more of: a calcium salt or a magnesium salt.

8. The process of claim 7, wherein the multivalent metal salt drying agent comprises a calcium salt.

9. The process of claim 8, wherein the calcium salt comprises calcium chloride.

10. The process of claim 1, wherein the multivalent metal salt drying agent is present on the at least one of the first and second surfaces to provide a black print density value of at least about 1.25.

11. The process of claim 10, wherein the multivalent metal salt drying agent is present on the at least one of the first and second surfaces to provide a black print density value of at least about 1.45.

12. The process of claim 1, wherein the multivalent metal salt drying agent present on the at least one of the first and second surfaces to provide an edge acuity (EA) value of less than about 15.

13. The process of claim 12, wherein the multivalent metal salt drying agent is present on the at least one of the first and second surfaces to provide an edge acuity (EA) value of less than about 10.

14. The process of claim 1, wherein the optical brightening agent is present in an amount sufficient to impart an ISO Brightness value of at least about 85.

15. The process of claim 14, wherein the optical brightening agent is present in an amount sufficient to impart an ISO Brightness value of at least about 90.

16. The process of claim 1, wherein the optical brightening agents comprises one or more of: 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, or benzimidazole-benzofurans or oxanilides.

17. The process of claim 16, wherein the optical brightening agent comprises one or more stilbene-based sulfonates.

18. The process of claim 17, wherein these one or more stilbene-based sulfonates comprise derivatives of 4,4'-diaminostilbene-2,2'-disulphonic acid, 4,4-bis(triazine-2-ylamino)stilbene-2,2'-disulphonic acid, disodium salts of distyrlbiphenyl disulfonic acid, or disodium salts of 4,4'-di-triazinylamino-2,2'-di-sulfostilbene.

19. The process of claim 1, wherein the optical brightening agent is present on the at least one of the first and second surfaces in an amount sufficient to impart a CIE Whiteness value of at least about 115.

20. The process of claim 19, wherein the optical brightening agent is present on the at least one of the first and second surfaces in an amount sufficient to impart a CIE Whiteness value of at least about 125.

21. The process of claim 20, wherein the optical brightening agent is present on the at least one of the first and second surfaces in an amount sufficient to impart a CIE Whiteness value of at least about 145.

22. The process of claim 1, wherein step (b) is carried out before step (a).

23. The process of claim 1, wherein step (b) is carried out after step (a).

24. The process of claim 1, wherein step (b) is carried out by spraying the other of the two agents onto the at least one surface of the paper substrate of step (a).

25. The process of claim 23, wherein step (a) is carried out by treating the at least one of the first and second surfaces of the paper substrate with the optical brightening agent, and wherein step (b) is carried out by treating the at least one surface of the paper substrate of step (a) with the multivalent metal salt drying agent.

26. The process of claim 1, wherein step (a) is carried out by treating the at least one of the first and second surfaces of the paper substrate with the multivalent metal salt drying agent, and wherein step (b) is carried out by treating the at least one surface of the paper substrate of step (a) with the optical brightening agent.

27. The process of claim 1, wherein the paper substrate comprises less than about 5% by weight mechanical pulp fibers.

28. The process of claim 27, wherein the paper substrate comprises less than about 1% by weight mechanical pulp fibers.

29. A process comprising the following steps:

(a) for a paper substrate comprising greater than about 10% by weight mechanical pulp fibers and having a first surface and a second surface, treating at least one of the first and second surfaces at a size press with one of the following two agents: (1) an optical brightening agent or; (2) a multivalent metal salt drying agent, to provide a treated paper substrate having one of the two agents; and (b) before or after the size press, treating the at least one surface of the paper substrate of step (a) with the other of the two agents to provide a printable substrate;

(c) wherein the least one surface after steps (a) and (b) comprises the multivalent metal salt drying agent in an amount such that the at least one surface has a black print density value of at least about 1.15;

(d) wherein the optical brightening agent is present after steps (a) and (b) in an amount sufficient to impart to the at least one surface an ISO brightness value of at least about 75.

30. The process of claim 29, wherein steps (a) and (b) are carried out on both the first and second surfaces.

31. The process of claim 30, wherein the first and second surfaces are treated with the multivalent metal salt drying agent at a pickup of from about 0.15 to about 3% by weight of the multivalent metal salt drying agent per ton of paper substrate.

32. The process of claim 31, wherein the first and second surfaces are treated with the multivalent metal salt drying agent at a pickup of from about 0.35 to about 1.3% by weight of the multivalent metal salt drying agent per ton of paper substrate.

33. The process of claim 30, wherein the first and second surfaces are treated with the optical brightening agent at a pickup 0.25 to about 3% by weight of the optical brightening agent per ton of paper substrate.

34. The process of claim 33, wherein the first and second surfaces are treated with the optical brightening agent at a pickup of from about 1 to about 2% by weight of the optical brightening agent per ton of paper substrate.

35. The process of claim 29, wherein the multivalent metal salt drying agent comprises one or more of: a calcium salt or a magnesium salt.

36. The process of claim 35, wherein the multivalent metal salt drying agent comprises a calcium salt.

37. The process of claim 36, wherein the calcium salt comprises calcium chloride.

38. The process of claim 29, wherein the multivalent metal salt drying agent is present on the at least one of the first and second surfaces to provide a black print density value of at least about 1.25.

39. The process of claim 38, wherein the multivalent metal salt drying agent is present on the at least one of the first and second surfaces to provide a black print density value of at least about 1.45.

40. The process of claim 38, wherein the multivalent metal salt drying agent present on the at least one of the first and second surfaces to provide an edge acuity (EA) value of less than about 15.

41. The process of claim 40, wherein the multivalent metal salt drying agent is present on the at least one of the first and second surfaces to provide an edge acuity (EA) value of less than about 10.

42. The process of claim 29, wherein the optical brightening agent is present in an amount sufficient to impart an ISO Brightness value of at least about 85.

43. The process of claim 42, wherein the optical brightening agent is present in an amount sufficient to impart an ISO Brightness value of at least about 90.

44. The process of claim 29, wherein the optical brightening agents comprises one or more of: 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, or benzimidazole-benzofurans or oxanilides.

45. The process of claim 44, wherein the optical brightening agent comprises one or more stilbene-based sulfonates.

46. The process of claim 45, wherein these one or more stilbene-based sulfonates comprise derivatives of 4,4'-diaminostilbene-2,2'-disulphonic acid, 4,4-bis(triazine-2-ylamino)stilbene-2,2'-disulphonic acid, disodium salts of distyrlbiphenyl disulfonic acid, or disodium salts of 4,4'-ditriazinylamino-2,2'-di-sulfostilbene.

47. The process of claim 29, wherein the optical brightening agent is present on the at least one of the first and second surfaces in an amount sufficient to impart a CIE Whiteness value of at least about 100.

48. The process of claim 46, wherein the optical brightening agent is present on the at least one of the first and second surfaces in an amount sufficient to impart a CIE Whiteness value of at least about 105.

49. The process of claim 48, wherein the optical brightening agent is present on the at least one of the first and second surfaces in an amount sufficient to impart a CIE Whiteness value of at least about 115.

50. The process of claim 29, wherein step (b) is carried out before step (a).

51. The process of claim 29, wherein step (b) is carried out after step (a).

52. The process of claim 47, wherein step (b) is carried out by spraying the other of the two agents onto the at least one surface of the paper substrate of step (a).

53. The process of claim 51, wherein step (a) is carried out by treating the at least one of the first and second surfaces of the paper substrate with the optical brightening agent, and wherein step (b) is carried out by treating the at least one surface of the paper substrate of step (a) with the multivalent metal salt drying agent.

54. The process of claim 47, wherein step (a) is carried out by treating the at least one of the first and second surfaces of the paper substrate with the multivalent metal salt drying agent, and wherein step (b) is carried out by treating the at least one surface of the paper substrate of step (a) with the optical brightening agent.

55. The process of claim 29, wherein the paper substrate comprises from about 15 to 100% by weight mechanical pulp fibers.

56. The process of claim 55, wherein the paper substrate comprises from about 50 to 95% by weight mechanical pulp fibers.

* * * * *